United States Patent [19]

Wong et al.

[11] Patent Number: 5,047,738

[45] Date of Patent: Sep. 10, 1991

[54] RIDGED WAVEGUIDE HYBRID

[75] Inventors: Harry Wong, Monterey Park; Mon N. Wong, Torrance, both of Calif.

[73] Assignee: Hughes Aircraft Company, Los Angeles, Calif.

[21] Appl. No.: 594,499

[22] Filed: Oct. 9, 1990

[51] Int. Cl.[5] ..... H01P 5/18

[52] U.S. Cl. ..... 333/113; 333/239

[58] Field of Search ..... 333/113, 114, 239

[56] References Cited

U.S. PATENT DOCUMENTS

| | | | |
|---|---|---|---|
| 2,876,421 | 3/1989 | Riblet | 333/113 |
| 4,691,177 | 9/1987 | Wong et al. | 333/113 |
| 4,818,964 | 4/1989 | Wong | 333/113 X |

FOREIGN PATENT DOCUMENTS

| | | | |
|---|---|---|---|
| 217763 | 2/1958 | Australia | 333/113 |

OTHER PUBLICATIONS

Southworth *Principles and Applications of Waveguide Transmission*, Van Nostrand Co., Princeton, N.J., 1965, Title page & pp. 134, 135.

Ragan, *Microwave Transmission Circuits*, (Rad. Lab Series 9), McGraw Hill, New York, N.Y., 1948, Title page & pp. 358,359.

*Primary Examiner*—Paul Gensler

*Attorney, Agent, or Firm*—Robert A. Westerlund; Steven M. Mitchell; Wanda K. Denson-Low

[57] ABSTRACT

A waveguide hybrid includes a generally rectangular superstructure defined by first and second conductive broad walls and first and second conductive narrow walls, and an intermediate, conductive narrow wall bifurcating the superstructure into first and second generally rectangular waveguides, with each of the waveguides being provided with a central, longitudinally extending land or ridge, preferably having a generally rectangular, cross-sectional profile. A coupling window is provided in a central portion of the intermediate narrow wall, which is shared in common by the first and second waveguides. Further, a capacitive button, which preferably takes the form of a square peg, is provided on the floor of the superstructure between the lateral surfaces of the common narrow wall which define the coupling window. In operation, RF energy, such as a microwave excitation signal, is injected into the input port of the first or primary waveguide, thereby launching a $TE_{10}$ mode which propagates through the primary waveguide towards its output port. A portion of the RF energy is coupled through the coupling window to thereby excite a $TE_{10}$ mode to propagate through the second or auxiliary waveguide. The capacitive button functions to enhance the coupling efficiency. The RF energy is ultimately output via the output ports of both the primary and auxiliary waveguides. with the output power present at the output port of the auxiliary waveguide phase-lagging the output power present at the output of the primary waveguide by 90 degrees. The input port of the secondary waveguide functions as an isolation port since it receives minimum power due to phase cancellation.

11 Claims, 1 Drawing Sheet

RIDGED WAVEGUIDE HYBRID

FIELD OF THE INVENTION

The present invention relates generally to waveguides of the type primarily utilized in microwave applications, and more particularly, to a ridged waveguide hybrid of novel design and architecture. It is presently contemplated that the present invention may have particular utility in connection with waveguide tee power divider corporate feed networks for microwave antennas.

BACKGROUND OF THE INVENTION

Presently available waveguide hybrids are comprised of adjacent waveguides which share a common narrow wall, with the common wall having a central opening formed therein to provide a coupling window. One of the waveguides serves as the primary waveguide and the other serves as the secondary or auxiliary waveguide. An excitation signal, generally a microwave signal, is impressed upon the input port of the primary waveguide and thence propagates in a $TE_{10}$ mode through the primary waveguide towards the output port thereof. A portion of the wave energy is radiated into the auxiliary waveguide through the coupling window. A series of capacitive blocks, oftentimes referred to as side blocks, are provided along the floor of each of the waveguides adjacent to the outside narrow walls thereof, in proximity to the coupling window, to thereby provide what is commonly referred to as a squeezed waveguide seciton, in order to facilitate optimum coupling efficiency.

Although these currently available waveguide hybrids perform in a satisfactory manner, they are unnecessarily large and difficult to fabricate. In certain applications, such as spaceborne satellite applications, where space is at a premium, and large numbers of hybrids are employed in the antenna feed network, the size and weight of the hybrids becomes a major consideration and design constraint. Although many efforts have been made in the past to reduce the size of waveguide hybrids, there still exists a need to further reduce their size, especially as the satellite antenna designs become increasingly complex and cumbersome. Further, because of the large numbers of hybrids employed in such designs, there also exists a need to simplify and render less expensive the manufacture of these waveguide hybrids.

The present invention addresses and satisfies these needs, thereby overcoming the shortcomings and limitations of the currently available waveguide hybrids.

SUMMARY OF THE INVENTION

The present invention encompasses a waveguide hybrid which includes a generally rectangular superstructure defined by first and second conductive broad walls and first and second conductive narrow walls, joined together along their longitudinal edges; an intermediate, conductive, narrow wall bifurcating the superstructure into first and second generally rectangular waveguides, with each of the waveguides being provided with a central, longitudinally extending land or ridge, preferably having a generally rectangular, cross-sectional profile; an opening or coupling window provided in a central portion of the intermediate narrow wall which is shared in common by the first and second waveguides; and, a capacitive button, which preferably takes the form of a generally square peg, provided on the floor of the superstructure between the lateral surfaces of the common narrow wall defining the coupling window.

In operation, the ridged waveguide hybrid of the present invention works in the following described manner. RF energy, such as a microwave excitation signal, is injected into the input port of the first or primary waveguide, thereby launching a $TE_{10}$ mode which propagates through the primary waveguide towards its output port. A portion of the RF energy propagating through the primary waveguide is coupled to the second or auxiliary waveguide through the coupling window, thereby exciting a $TE_{10}$ mode along the auxiliary waveguide. The capacitive button enhances the coupling efficiency. The amount or degree of coupling can be controlled by simply varying the length of the coupling window and/or the dimensions of the button (e.g. its height). Of course, the RF energy is ultimately output via the output ports of both the primary and auxiliary waveguides, with the output power present at the output port of the auxiliary waveguide phase-lagging the output power present at the output port of the primary waveguide by 90 degrees. The input port of the secondary waveguide functions as an isolation port since it receives minimum power due to phase cancellation.

The ridges function to lower the cut-off operating frequency of the waveguide hybrid, thereby enabling a significant reduction (38%, in the preferred embodiment) in the overall size and weight of the waveguide hybrid of the present invention relative to currently available waveguide hybrids. Further, the utilization of a capacitive button to optimize coupling efficiency eliminates the necessity of the side blocks which are required in currently available waveguide hybrids, thereby reducing the cost and complexity of manufacturing or fabricating the waveguide hybrid.

BRIEF DESCRIPTION OF THE DRAWINGS

The various features and advantages of the present invention may be more readily understood with reference to the following detailed description taken in conjunction with the accompanying drawings, wherein like reference numerals and characters designate like elements, and in which.

DETAILED DESCRIPTION OF THE INVENTION

Figure 1:
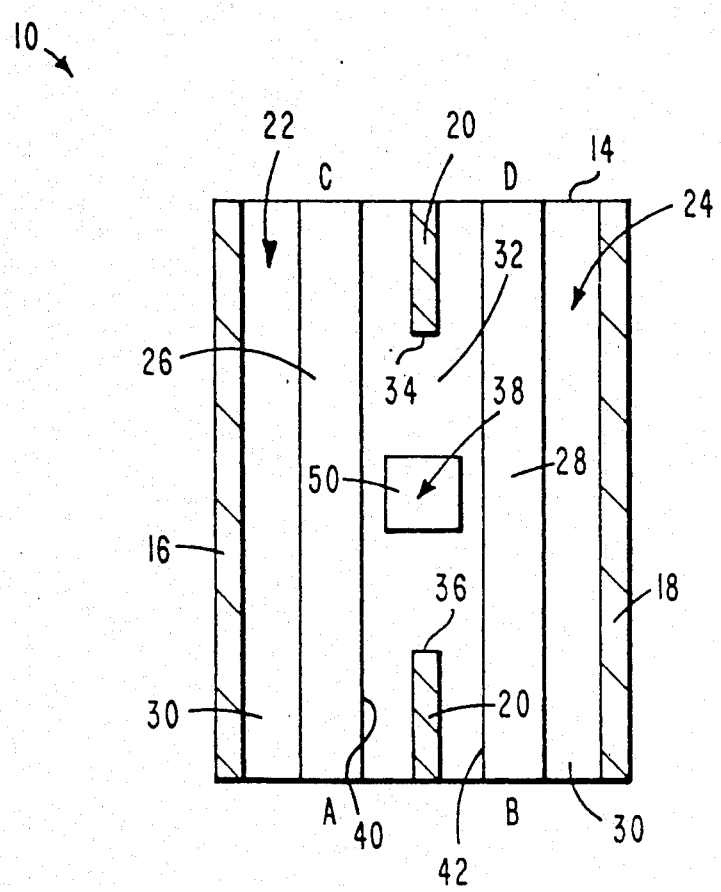
FIG. 1 is a top plan view of the ridged waveguide hybrid of the present invention, with the top broad wall thereof removed.
Figure 2:
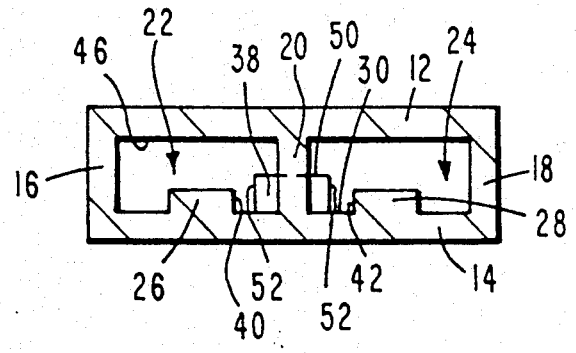
FIG. 2 is an end view of the ridged waveguide hybrid depicted in FIG. 1, with the top broad wall thereof intact.

Referring now to FIGS. 1 and 2, there can be seen a ridged waveguide hybrid 10 constituting a presently preferred embodiment of the instant invention. The waveguide hybrid 10 is comprised of top and bottom broad walls 12, 14, respectively, joined together by outer narrow walls 16, 18, and by an intermediate narrow wall 20 which bifurcates the waveguide hybrid 10 along its longitudinal axis, to thereby define first and second waveguides 22, 24, which share in common the intermediate narrow wall 20. The input and output ports of the first waveguide 22 are designated A and C, respectively, and the isolation and output ports of the second waveguide 24 are designated B and D, respectively. The walls 12, 14, 16, 18, and 20 are formed from an electrically conductive material, such as silver-plated or gold-plated aluminum, although the particular material used is not limiting to the present invention. The waveguide hybrid 10 also includes first and second elongated ribs or lands 26, 28, respectively, of generally rectangular profile (in horizontal cross-section), commonly referred to in the art as ridges, provided on the upper surface 30 of the bottom broad wall 14 (i.e. the waveguide floor 30) parallel to the common narrow wall 20, but on opposite sides thereof. The ridges 26, 28 are preferably coincidental and coextensive with the longitudinal centerline of their respective waveguides 22, 24.

Referring still to FIGS. 1 and 2, it can be seen that the common narrow wall 20 is notched out or interrupted at its central region, to thereby provide an aperture or coupling window 32, the purpose and function of which will be hereinafter described. The opposing, lateral surfaces 34, 36 of the common narrow wall 20 which define the coupling window 32 are preferably equidistant from the respective opposite ends of the waveguide hybrid 10 which they are nearer to, i.e. the distance from the surface 34 to the output port end (C,D) of the waveguide hybrid 10, is preferably equal to the distance from the surface 36 to the input port end (A,B) of the waveguide hybrid 10. Additionally, a capacitor in the form of a generally box-shaped post or button 38 is provided on the waveguide floor 30 at a location which is preferably equidistant from the inner, longitudinal walls 40, 42 of the ridges 26, 28, respectively, and further, preferably equidistant from the opposing lateral surfaces 34, 36 of the common narrow wall 20. Otherwise stated, the button 38 is located at the center of the coupling window 32. The purpose and function of the button 38 will be hereinafter described.

In operation, the ridged waveguide hybrid 10 works in the following described manner. RF energy (not shown), such as a microwave excitation signal, from any convenient source (not shown), such as a satellite antenna feed network, is injected into input port A, thereby launching a $TE_{10}$ mode which propagates through the first waveguide 22 towards the output port C. The maximum E-field (not shown) occurs between the surface of the ridge 26 and the inner surface 46 of the top broad wall 12 (i.e. the waveguide ceiling 46). The E-vector (not shown) of this maximum E-field is perpendicular to both the waveguide ceiling 46 and the ridge 26 of the first waveguide 22. The RF energy propagating in the $TE_{10}$ mode through the first waveguide 22 is coupled to the second or auxiliary waveguide 24 through the coupling window 32, whereby the H-field, a transversal current, is permitted to flow through the coupling window 32, thereby exciting a $TE_{10}$ mode along the auxiliary waveguide 24. The maximum E-field (not shown) of this $TE_{10}$ mode occurs between the surface of the ridge 28 and the waveguide ceiling 46. The E-vector (not shown) of this maximum E-field is perpendicular to both the waveguide ceiling 46 and the ridge 28 of the auxiliary waveguide 24. The capacitance of the button 38 enhances this coupling of RF energy between the first and second waveguides 22, 24, and also increases the operational bandwidth (BW) of the waveguide hybrid 10. The amount or degree of coupling can be controlled by simply varying the length of the coupling window 32 and the dimensions (e.g. the height) of the button 38. Of course, the RF energy is ultimately output via output ports C,D, with the output power present at port D phase-lagging the output power present at port C by 90°. Port B receives minimum power due to phase cancellation and is therefore referred to as the isolation port.

The ridge 26 provided on the floor 30 of the first waveguide 22 functions to lower the cut-off operating frequency thereof. Likewise, the ridge 28 provided on the floor 30 of the second or auxiliary waveguide 22 functions to lower the cut-off operating frequency thereof. These ridges are an important feature of the present invention, as they provide the waveguide hybrid 10 of the present invention with a significant advantage over all known waveguide hybrids, in that the traditional rectangular waveguide cut-off wavelength is $c=2a$, while the ridged rectangular waveguides 22, 24 exhibit a cut-off wavelength of $c=2a$ to $6a$, depending upon the size of its respective ridge 26, 28; wherein, c is a short-hand designation for the cut-off wavelength, $\lambda_c$, and a is the wide dimension of the waveguides. Thus, it can be readily appreciated that this aspect of the present invention enables a reduction in the overall size and weight of the waveguide hybrid 10 relative to currently available waveguide hybrids. It should be recognized that size and weight are important and oftentimes critical parameters in certain applications, e.g., spaceborne satellite applications, where the cost per unit weight is at a very high premium and the number of hybrids required may be enormous. In fact, it is presently contemplated that the four port hybrid of the presently preferred embodiment of the instant invention may have particular utility in the environment of corporate feed networks for satellite antennas, e.g., the hybrid may be incorporated into a waveguide tee power divider corporate feed, for example, with one hybrid being installed with every 4 to 6 waveguide tee power divider for the absorption of reflected power due to RF mismatch. Further, the utilization of a capacitive button to optimize coupling efficiency eliminates the necessity of the side blocks which are required in currently available waveguide hybrids, thereby reducing the cost and complexity of manufacturing or fabricating the waveguide hybrid of the present invention relative to that of currently available waveguide hybrids.

Although not limiting to the above-described generic inventive concepts, features, and principles of the present invention, the dimensions of the waveguide hybrid 10 are most preferably as set forth below, in order to optimize the signal-handling characteristics (i.e. RF mismatch, reflection losses, etc.). These preferred waveguide dimensions will be defined in terms of scaling factors which are expressed in terms of a multiplier constant, and a multiplicand variable which is equal to the free-space wavelength (i.e. the wavelength in an unbounded medium), $\lambda_0$, hereinafter referred to as WV, of the RF input/excitation signal (i.e. the operating frequency of the hybrid 10). More particularly, the preferred dimensions are as follows: the overall width dimension W of the entire structure constituting the waveguide hybrid 10 (i.e. the superstructure) is approximately 1.282 WV; the overall length dimension L of the entire structure constituting the waveguide hybrid 10 is approximately 1.696 WV; the length L1 of the coupling window 32 is approximately 0.924 WV; the internal width dimension W1 of each of the waveguides 22, 24 is approximately 0.49 WV; and, the internal height dimension H of the waveguides 22, 24 is approximately 0.226 WV.

In an actual embodiment of the present invention, a waveguide hybrid built to operate on microwave power at 22.25 GHz, the above-defined dimensions, in accordance with the scaling factors delineated above, are as follows: W=0.680"; L=0.900"; L1=0.490"; W1=0.260"' and, H=0.120". Further, the width of each of the walls 12, 14, 16, 18, and 20 is approximately 0.040"; the width of each of the ridges 26, 28 is 0.104" and the height of each of the ridges 26, 28 is 0.042"; and, the button 38 has a 0.12" square planar top surface 50 and a height of 0.048". Moreover, in this actual embodiment, each of the upright faces 52 of the button 38 are planar and of rectangular shape (i.e. a height of 0.048" and a width of 0.12"). Thus, in this actual embodiment, each of the surfaces of the button 38 are planar, to thereby facilitate ease of machining thereof. Additionally, the upright faces 52 are perpendicular to the top surface 50 of the button 38, rather than being tapered, to thereby further facilitate greater ease in the machining of the button 38. It was determined that the overall dimensions of this actual embodiment of the hybrid 10 of the present invention were 38% less than a 22.25 GHz waveguide hybrid of conventional design. Therefore, since these dimensions were determined by using the scaling factors defined hereinabove, it is quite apparent that a waveguide hybrid designed to operate at any frequency will have an overall size which is 38% less than a comparable hybrid of conventional design, if designed in accordance with the scaling factors which define the most preferred embodiment of the present invention.

Although the present invention has been described in some detail and in the specific context of preferred and actual embodiments thereof, it should be clearly understood that various modifications and embodiments of which may appear to those skilled in the art will still fall within the spirit and scope of the broader generic inventive concepts taught herein. For example, the specific dimensions of the waveguide hybrid may vary depending upon the particular application and its particular requirements, e.g., with regard to operational parameters and signal-handling characteristics. Moreover, in this same vein, it should be recognized that the specific method of construction of the waveguide hybrid is not limiting to the present invention. For example, the various walls 12, 14, 16, 18, and 20 which collectively define the first and second waveguides 22, 24, respectively, rather than being integrally joined together as a unitary piece (e.g. machined from a single block), may suitably be comprised of discrete wall segments which are joined together in any convenient manner known in the art, e.g., by soldering, welding or brazing. Accordingly, the present invention should not be limited to the specific embodiments disclosed herein, but rather, should be accorded the widest scope consistent with the principles and features disclosed herein.

What is claimed is:

1. A waveguide hybrid, comprising:

a generally rectangular open-ended, hollow superstructure defined by a pair of parallel, opposed, conductive, narrow walls, and a pair of parallel, conductive, opposed, broad walls, joined together along their longitudinal edges;

an intermediate, conductive, narrow wall joining said pair of broad walls along the longitudinal centerline thereof, thereby bifurcating said superstructure into first and second generally rectangular waveguides, with said first waveguide having first and second ports disposed, respectively, at opposite ends thereof, and said second waveguide having first and second ports disposed, respectively, at opposite ends thereof;

a first ridge provided on the interior surface of a first one of said broad walls along the longitudinal centerline of said first waveguide;

a second ridge provided on the interior surface of said first one of said broad walls along the longitudinal centerline of said second waveguide;

an opening provided in a central portion of said intermediate narrow wall; and, a capacitive button provided on the interior surface of said first one of said broad walls within said opening.

2. The hybrid as set forth in claim 1, wherein and excitation RF signal is impressed upon said first port of said first waveguide, whereby:

said RF signal propagates in a $TE_{10}$ mode through said first waveguide from said first port thereof towards said second port thereof, with a portion of said RF signal being coupled through said opening to propagate in a $TE_{10}$ mode through said second waveguide towards said second port thereof;

said capacitive button functions to enhance the coupling of said coupled portion of said RF signal into said second waveguide;

said coupled portion of said RF signal present at said second port of said second waveguide phase-lags said RF signal present at said second port of said first waveguide by 90°; and, said first port of said second waveguide functions as an isolation port.

3. The hybrid as set forth in claim 1, wherein:

said first waveguide functions as a primary waveguide;

said second waveguide functions as an auxiliary waveguide;

said first port of said primary waveguide functions as an input port;

said second port of said primary waveguide functions as a first output port;

said second port of said auxiliary waveguide functions as a second output port;

said first port of said auxiliary waveguide functions as an isolation port; and, said opening functions as a coupling window.

4. The hybrid as set forth in claim 2, wherein:

said excitation RF signal has a prescribed free-space wavelength defined as WV;

the width dimension of said superstructure is approximately 1.282 WV;

the length dimension of said superstructure is approximately 1.696 WV; and, the length of said openind is approximately 0.924 WV.

5. The hybrid as set forth in claim 4, wherein the internal width dimension of each of said first and second waveguides is approximately 0.49 WV and the internal height dimension of each of said first and second waveguides is approximately 0.226 WV.

6. The hybrid as set forth in claim 1, wherein said capacitive button comprises a generally cube shaped post.

7. The hybrid as set forth in claim 6, wherein said generally cube shaped post is comprised of four quadrilateral, planar surfaces joined together along their uprightly extending edges and mutually terminating in a top, quadrilateral, planar surface.

8. The hybrid as set forth in claim 7, wherein said top planar surface is square.

9. The hybrid as set forth in claim 7, wherein each of said upright surfaces are disposed perpendicular to said top surface.

10. The hybrid as set forth in claim 1, wherein each of said first and second ridges have a generally rectangular cross-sectional profile.

11. The hybrid as set forth in claim 7, wherein each of said first and second ridges have a generally rectangular cross-sectional profile.

* * * * *